US005911207A

United States Patent [19]

Ohishi et al.

[11] Patent Number: 5,911,207

[45] Date of Patent: Jun. 15, 1999

[54] FUEL INJECTION PUMP

[75] Inventors: Takashi Ohishi; Toshihumi Noda; Tohru Yokota; Nobuhiro Kitahara, all of Saitama Prefecture, Japan

[73] Assignee: Zexel Corporation, Tokyo, Japan

[21] Appl. No.: 09/025,664

[22] Filed: Feb. 18, 1998

[30] Foreign Application Priority Data

Feb. 18, 1997 [JP] Japan ..... 9-48591

[51] Int. Cl.[6] ..... F02M 34/00; F02B 3/00

[52] U.S. Cl. ..... 123/299; 123/500

[58] Field of Search ..... 123/500, 501, 123/502, 299, 300

[56] References Cited

U.S. PATENT DOCUMENTS

| | | | |
|---|---|---|---|
| 3,439,655 | 4/1969 | Eyzat | 123/299 |
| 4,705,005 | 11/1987 | Guntert | 123/500 |
| 4,840,161 | 6/1989 | Eckell et al. | 123/500 |
| 5,233,955 | 8/1993 | Kraemer et al. | 123/299 |

FOREIGN PATENT DOCUMENTS

| | | |
|---|---|---|
| 63-121772 | 8/1988 | Japan . |
| 63-191266 | 12/1988 | Japan . |
| 6-117341 | 4/1994 | Japan . |

*Primary Examiner*—Thomas N. Moulis

*Attorney, Agent, or Firm*—Ostrolenik, Faber, Gerb & Soffen, LLP

[57] ABSTRACT

An objective of the present invention is to provide a fuel injection pump wherewith, in addition to main injection, pre-injection is made possible in the vicinity of top dead center in the exhaust stroke, and wherewith, by regulating the pre-stroke, defined as the stroke from bottom dead center of a plunger 2 to the commencement of fuel line pressurization, it is possible to freely control both the pre-injection volume and the pre-injection timing relative to the main injection. Attention having been given to the combining of a pre-stroke varying mechanism together with a two-stage injection mechanism, the present invention is a fuel injection pump that is made so that a pre-stroke is regulated by changing the relative positions, in the axial direction, of a plunger 2 that sends fuel under pressure and a control sleeve 3 that fits around the outside of the plunger 2 so as to slide freely thereon. The cam 4 that drives the plunger 2 comprises a main cam nose 20 for main injection use and a pre cam nose 21 for pre-injection use.

9 Claims, 5 Drawing Sheets

FUEL INJECTION PUMP

BACKGROUND OF THE INVENTION

1. Field of the Invention

The present invention relates to fuel injection pumps used in diesel engines and other internal combustion engines, and more particularly to a fuel injection pump that is a variable-pre-stroke type made so that a preparatory injection (pre-injection) is performed near exhaust top dead center in a diesel engine.

2. Description of the Related Art

Conventionally, in diesel engines of the direct injection type in which fuel is directly injected into the combustion chambers, a small quantity of fuel is injected preparatorily (pre-injected) in the vicinity of opposite phase of the main injection, that is, before the cam angle becomes approximately 180 degrees (near top dead center in the exhaust stroke), for the purpose of reducing nitrogen oxides (NOx).

More specifically, the purpose of this pre-injection is to create a condition wherein the fuel is in an atomized state near top dead center in the compression stroke of the engine, thereby sharply reducing main injection ignition lag and reducing NOx. Examples of this are to be seen in laid-open Util. Mod. Ap. No. S63-121772 [1988], laid-open Util. Mod. Ap. No. 63-191266 [1988], and laid-open Pat. Ap. No. H6-117341 [1994], etc.

However, if the fuel injection pump is of the accumulator type which uses something like a common rail, the necessary pressure can be secured with any desired timing, which makes it comparatively easy to implement this kind of two-stage injection employing main injection and pre-injection. In a jerk-type fuel injection pump in which a plunger is caused to reciprocate up and down in a plunger barrel, it is very difficult to implement two-stage injection while making the pre-injection volume variable, and a structure for implementing this is desired.

It is also desirable that two-stage injection be implemented with which the timing of the pre-injection relative to the main injection can be freely controlled.

SUMMARY OF THE INVENTION

With the problems noted in the foregoing in view, it is an object of the present invention to provide a fuel injection pump which makes pre-injection possible in the vicinity of the opposite phase of the main injection.

Another object of the present invention is to provide a fuel injection pump which makes pre-injection possible near top dead center in the exhaust stroke, in addition to main injection and pilot injection immediately prior to the main injection.

Another object of the present invention is to provide a fuel injection pump with which the pre-injection volume can be made variable by regulating the pre-stroke where pre-stroke is defined as the stroke from the bottom dead center of the plunger to the commencement of fuel-line pressurization.

Another object of the present invention is to provide a fuel injection pump with which two-stage injection can be implemented with which, in turn, the pre-injection timing, relative to main injection, can be freely controlled.

Attention having been given both to the combining of a pre-stroke varying mechanism together with a two-stage injection mechanism, and to the provision of two cam noses in the two-stage injection mechanism, one for main injection and one for pre-injection, the present invention is a fuel injection pump that, while comprising a plunger barrel having a fuel pressure chamber, a plunger that reciprocates up and down inside said plunger barrel, pulling fuel into said fuel pressure chamber from a fuel collection chamber via a fuel intake-discharge port, and sending this fuel along under pressure, a freely sliding control sleeve that fits over said plunger, and a cam that drives said plunger, is fashioned so that the pre-stroke is regulated by changing the relative positions of said control sleeve and said plunger in the axial dimension, said cam comprising a main cam nose for the main injection, and a pre cam nose for pre-injection positioned roughly 180 degrees before said main cam nose.

In the fuel injection pump that is according to the present invention, a cam is employed which has a main cam nose used for main injection and a pre cam nose used for pre-injection. The plunger is driven by this cam, and small-volume pre-injection is performed with timing in the vicinity of top dead center in the normal exhaust stroke, the cam angle being phase-shifted approximately 180 degrees from the main injection that is performed in the vicinity of top dead center in the compression stroke of an ordinary engine. Thus a condition, wherein a small quantity of fuel is diffused inside the combustion chamber, is secured in the initial state of the next air-intake stroke, performing vaporization and atomization in the compression stroke of the engine, thus making it possible to prevent ignition lag, to effect stabilized combustion, and to reduce NOx.

In addition, it is possible to make both the pre-injection volume and the timing relative to the main injection variable by moving the control sleeve in the axial dimension relative to the plunger, thereby regulating the pre-stroke.

It also becomes possible to perform, together with the main injection, a pilot injection immediately prior thereto, by forming in the control sleeve a main-injection cut-off port and a pilot-injection cut-off port, and, together therewith, forming in the plunger a pilot spill slit and an inclined control channel corresponding thereto, respectively, thus making it possible to effect, in addition to the pre-injection described above, combustion conditions that are stabilized even more.

DESCRIPTION OF THE PREFERRED EMBODIMENTS

Figure 1:
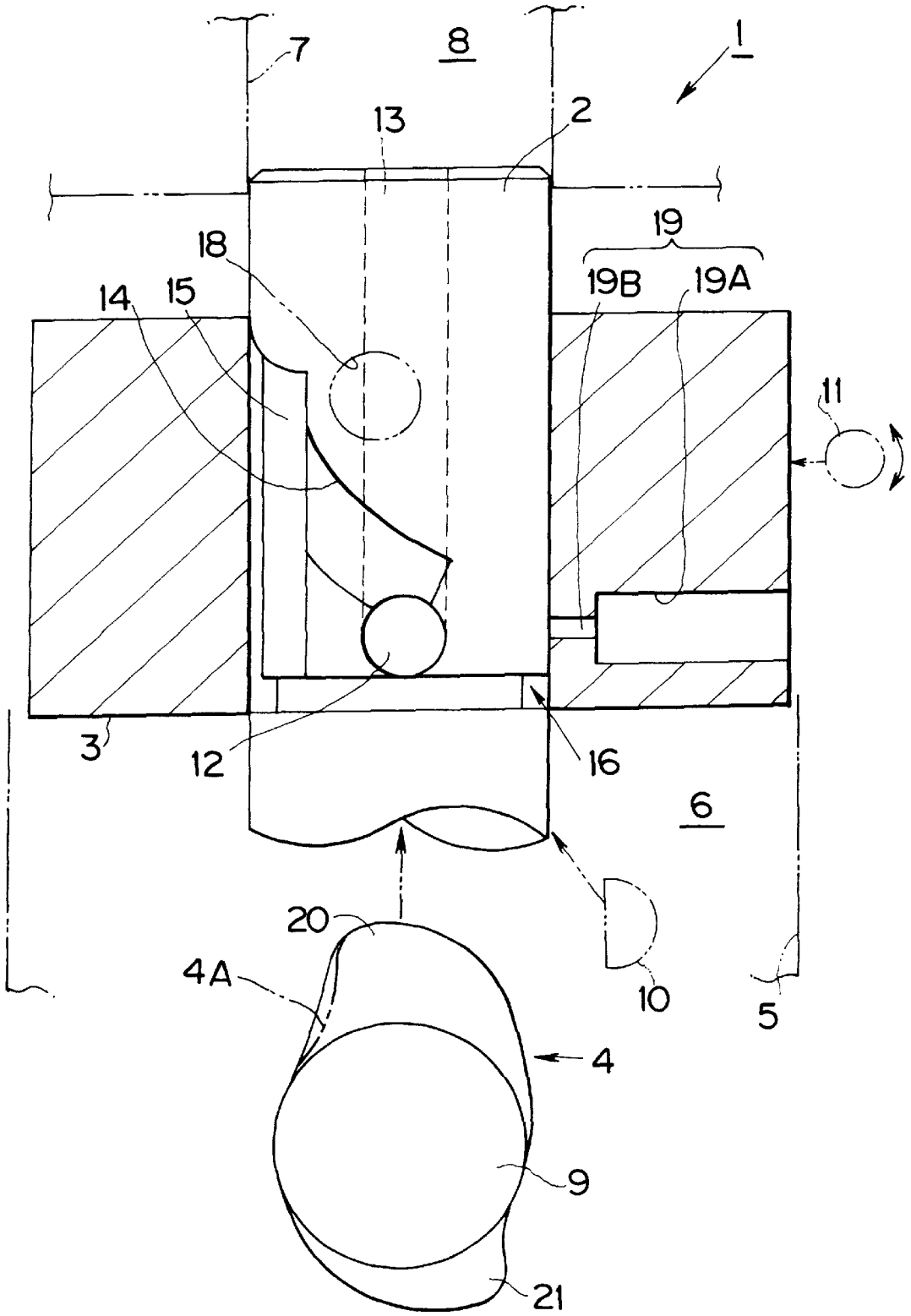
FIG. 1 is an enlarged vertical cross-sectional view of critical components in a fuel injection pump 1, based on an embodiment of the present invention, and equipped with a pre-stroke varying mechanism, namely a plunger 2, a control sleeve 3, and a cam 4.
Figure 2:
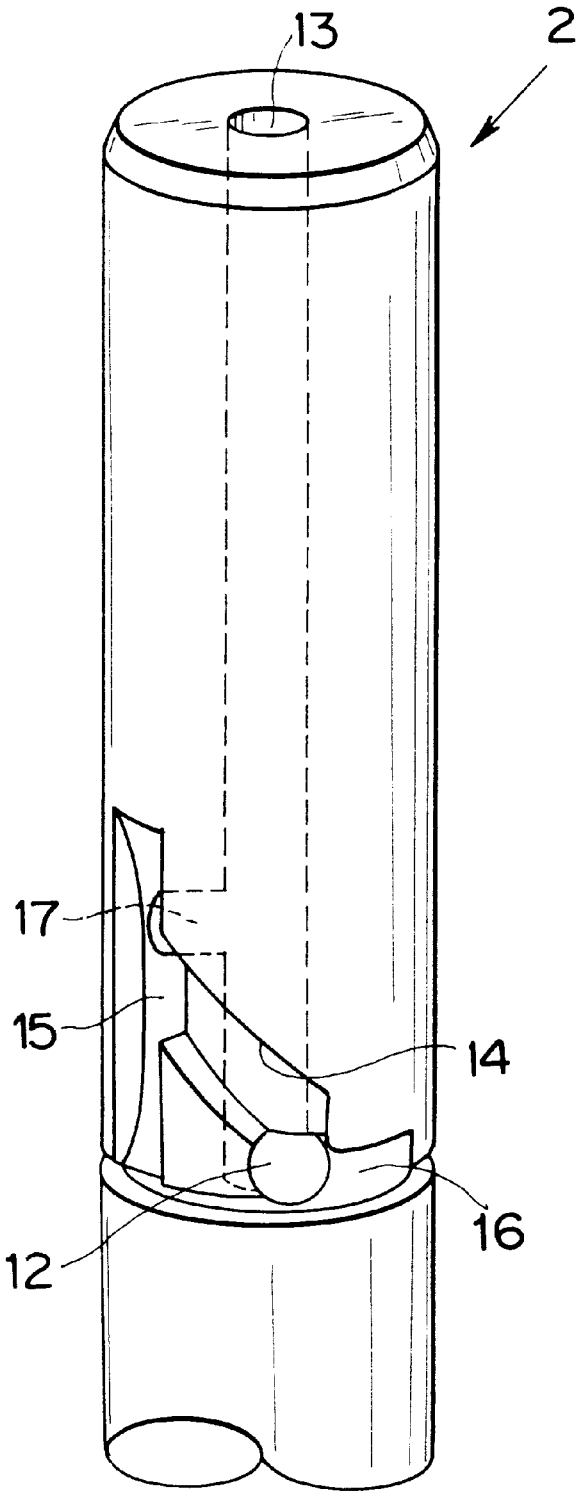
FIG. 2 is a diagonal view of the plunger 2 thereof.
Figure 3:
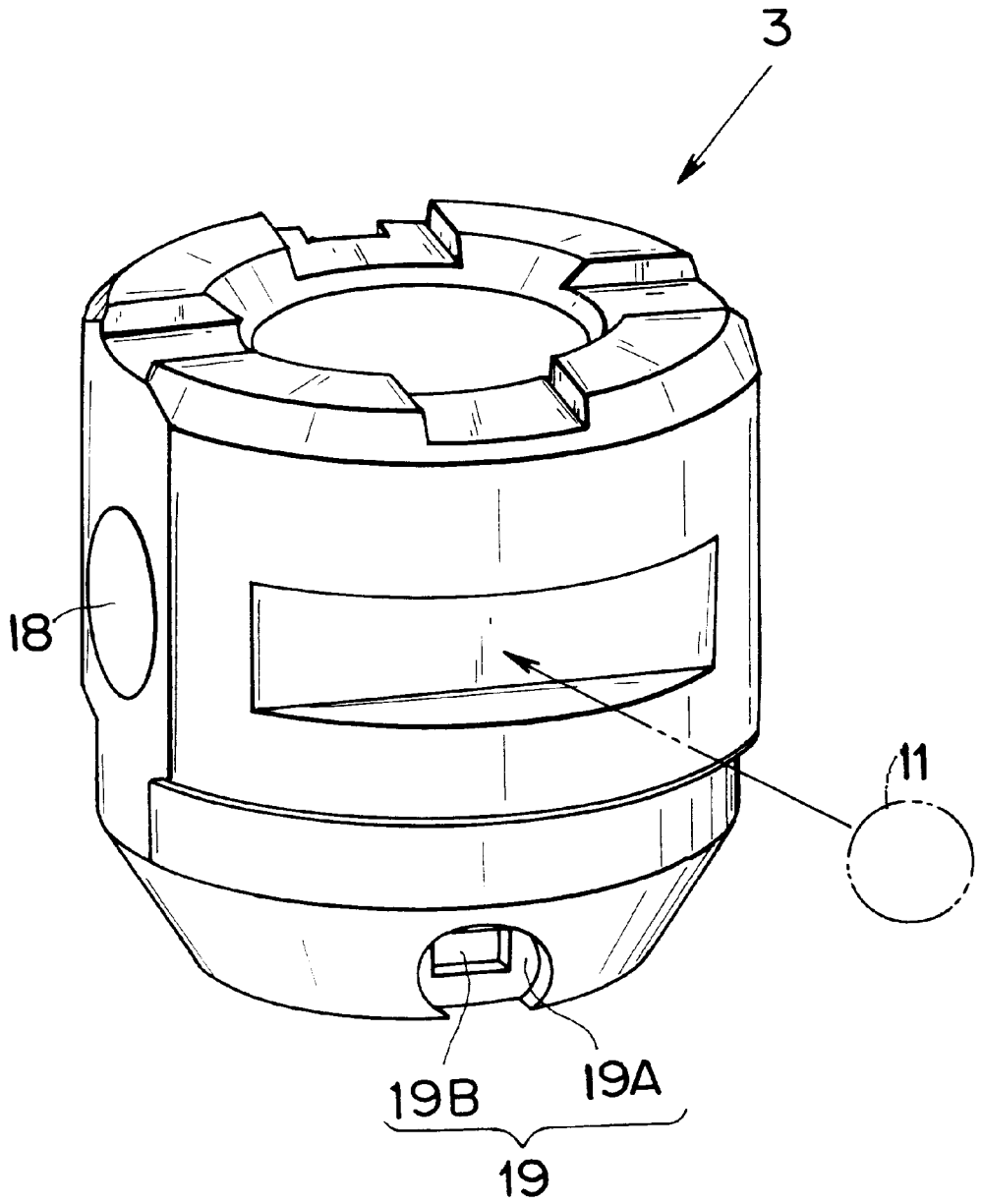
FIG. 3 is a diagonal view of the control sleeve 3 thereof.

A description is now given of a fuel injection pump, based on an embodiment of the present invention, and equipped with a pre-stroke varying mechanism, making reference to FIG. 1 through 5. FIG. 1 provides an enlarged vertical cross-sectional view of critical components in the fuel injection pump 1, namely a plunger 2, a control sleeve 3, and a cam 4; FIG. 2 provides a diagonal view of the plunger 2;

and FIG. 3 provides a diagonal view of the control sleeve 3. In particular, as is depicted in FIG. 1, this fuel injection pump 1 forms a fuel collection chamber 6 between a pump housing 5 and the plunger 2, and, at the same time, forms a fuel compression chamber 8 between a plunger barrel 7 and the plunger 2.

The plunger 2 reciprocates up and down inside the plunger barrel 7 due to the cam 4 provided on a camshaft 9, so the camshaft 9 links this to an engine (not shown in the drawing), being driven so by the engine so as to turn.

The plunger 2 is such that it can be made to turn by driving an injection-volume regulating rod 10 in a direction perpendicular to the plane of the page.

In other words, the effective line-pressurizing stroke for injecting fuel can be regulated by turning the plunger 2 by this injection-volume regulating rod 10.

The control sleeve 3 noted above is fit around the upper part of the plunger 2 such that it can freely slide.

By moving the control sleeve 3 up and down by turning a timing control rod 11 which engages the control sleeve 3, it is possible to regulate the relative positions of the plunger 2 and control sleeve 3 in the axial direction, to vary the pre-stroke of the plunger 2, and to control the fuel injection timing. The pre-stroke is defined as the dimension from bottom dead center of the plunger 2 to the commencement of fuel line pressurization.

More specifically, when the timing control rod 11 is turned in the clockwise direction to move the control sleeve 3 upward, the pre-stroke becomes larger, the injection commencement time is retarded (angle of lag), and a high injection ratio (ratio of fuel injection volume to unit turning angle of the camshaft 9; i.e. the ratio of change over time in injection volume) is obtained that is well suited to the low-speed turning region where engine rpm is low.

Conversely, when the timing control rod 11 is turned in the counterclockwise direction to move the control sleeve 3 downward, the pre-stroke becomes smaller, the injection period is made earlier (angle of advance), and a low injection ratio is obtained that is well suited to high-speed turning. However, the absolute injection volume does increase.

The plunger 2 that slides freely inside the plunger barrel 7 reciprocates inside the plunger barrel 7 when it is acted on by the turning drive force of the engine via the camshaft 9 and the cam 4, whereupon fuel inside the fuel collection chamber 6 is pulled into the fuel compression chamber 8 while, at the same time, the fuel inside this fuel compression chamber 8 is sent under pressure through a fuel discharge port and injection line (neither of which is shown in the diagram) so that it is injected from an injection nozzle (not shown in the diagram).

More specifically, the plunger 2 comprises a fuel intake-discharge hole 12, in the direction of the diameter, which opens into the fuel collection chamber 6, a center communicating hole 13 formed in the direction of the center axis so as to communicate with the fuel intake-discharge hole 12 and the fuel compression chamber 8, an inclined control channel 14 formed in the outer surface thereof, a vertical communicating channel 15 that communicates between the inclined control channel 14 and the fuel intake-discharge hole 12, a pilot spill slit 16 that communicates with the lower end of the fuel intake-discharge hole 12, and an auxiliary communicating hole 17 (cf. FIG. 2). The pilot spill slit 16 is to be formed in a ring shape, traversing a designated length, such as the total circumference, in the outer circumferential surface of the plunger 2, or, alternately, traversing a designated length within the turning range of the plunger 2, in a plane (horizontal plane) that is perpendicular to the axial dimension of the plunger 2, so as to communicate with the fuel intake-discharge hole 12.

The pilot spill slit 16, furthermore, may also be formed in a position that is lower than either the fuel intake-discharge hole 12, the center communicating hole 13, the inclined control channel 14, or the vertical communicating channel 15, so that it can communicate with any of those.

The auxiliary communicating hole 17, moreover, is formed so that it communicates directly between the center communicating hole 13 and the vertical communicating channel 15, so that it can efficiently supply and discharge fuel.

A main-injection cut-off port 18 is formed all the way through the control sleeve 3, in a radial direction thereof, that fits around the plunger 2 and slides freely thereon.

The main-injection cut-off port 18 is to be so positioned that it bears a vertical positional relationship with the inclined control channel 14 such that it can communicate therewith, in response to the up-and-down movements of the plunger 2.

Furthermore, in addition to the inclined control channel 14 in the plunger 2 and the main-injection cut-off port 18 described above, a pilot-injection cut-off port 19 is formed in the control sleeve 3, for pilot injection use, as diagrammed in FIG. 1. The pilot-injection cut-off port 19 is to be formed in the control sleeve 3 in a position that relates to the pilot spill slit 16 in the radial dimension of the plunger 2.

However, this pilot-injection cut-off port 19 is to be formed of a large-diameter part 19A and a small-diameter part 19B, and it is to be formed further toward the lower end of the control sleeve than the main-injection cut-off port 18.

On the cam 4 noted earlier, moreover, a main cam nose 20 is formed for main injection and a pre cam nose 21 is formed for pre-injection.

The angle between the main cam nose 20 and the pre cam nose 21 is to be roughly 180 degrees, and, whereas main injection is to be conducted in the vicinity of top dead center in the compression stroke of the engine, pre-injection is to be performed in the vicinity of top dead center in the exhaust stroke.

Needless to say, the formation is such that the amount of lift in the plunger 2 by the main cam nose 20 is greater than that by the pre cam nose 21.

The operation of the fuel injection pump 1 configured in this manner is now described.

Figure 4:
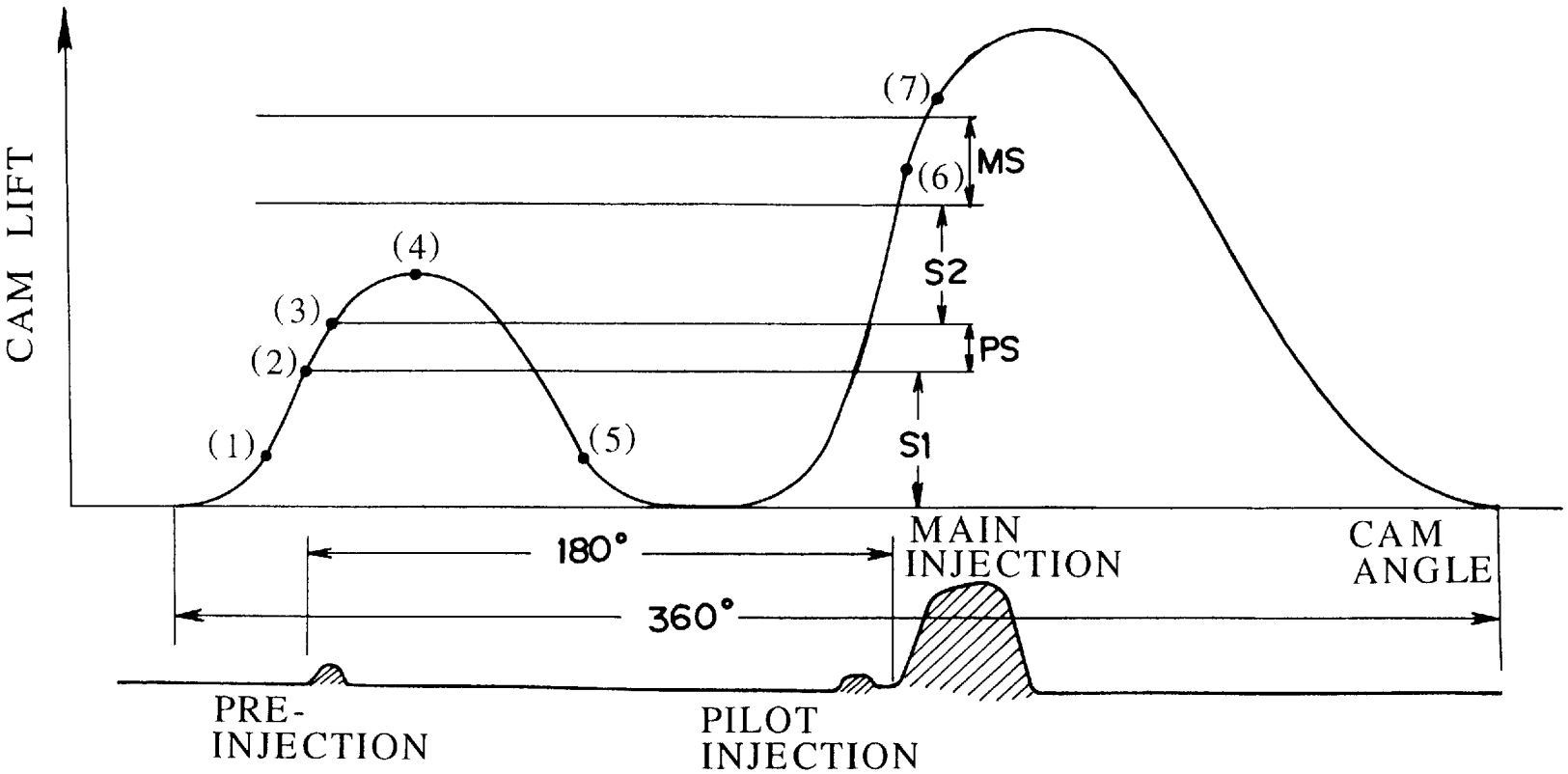
FIG. 4 is a graph plotting cam lift against cam angle for the cam 4.
Figure 5:
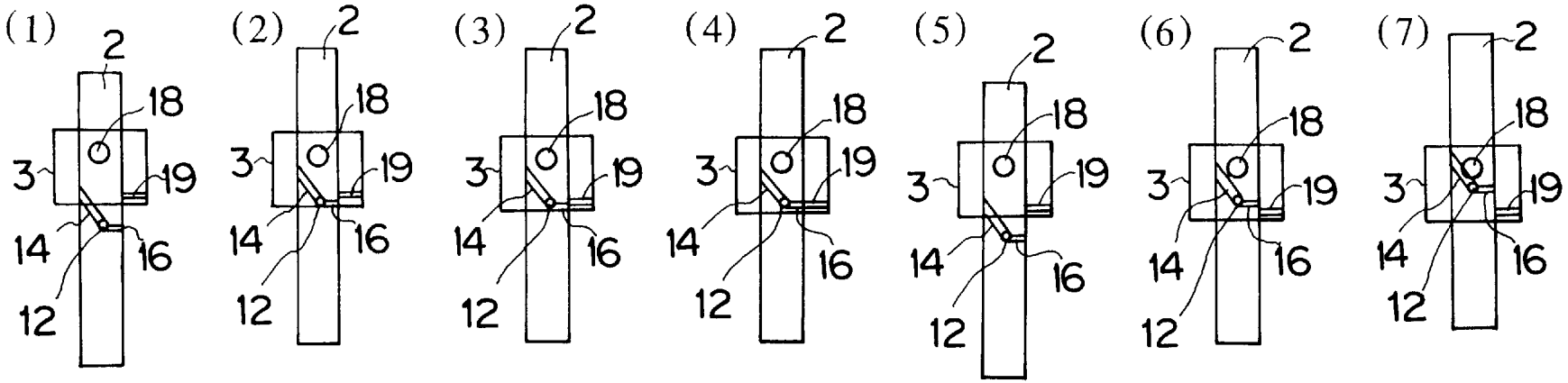
FIG. 5 is a collection of explanatory diagrams which, respectively, depict the relative positions of the plunger 2 and the control sleeve 3 for seven lift conditions in the FIG. 2 graph, namely (1), (2), (3), (4), (5), (6), and (7).

FIG. 4 is a cam-lift graph for cam angles of the cam 4. FIG. 5 is a collection of explanatory diagrams indicating, respectively, relative positions of the plunger 2 and the control sleeve 3 in various lift conditions in the graph in FIG. 4, namely conditions (1), (2), (3), (4), (5), (6), and (7). In lift condition (1), the sending of fuel under pressure has not yet commenced, with the turning drive of the cam 4.

More specifically, when the plunger 2 initially begins rising from bottom dead center, the fuel intake-discharge hole 12 and pilot spill slit 16 are open to the fuel collection chamber 6, and the fuel collection chamber 6 and fuel compression chamber 8 communicate via the fuel intake-discharge hole 12 and center communicating hole 13, so the pressure on the fuel inside the fuel compression chamber 8 does not rise, and the sending of fuel under pressure has not yet begun.

In lift condition (2) pre-injection commences. More specifically, the plunger rises due to the pre cam nose 21, and, when the pilot spill slit 16 thereof is closed off by the lower end of the control sleeve 3, the pressure on the fuel inside the fuel compression chamber 8 rises, fuel is sent under pressure (fuel line pressurization), and pre-injection commences. Then, in lift condition (3), pre-injection terminates.

More specifically, pre-injection is terminated by the fuel inside the fuel compression chamber 8 spilling into the fuel collection chamber 6, due to the communication between the pilot spill slit 16 of the plunger 2 and the small-diameter part 19B of the pilot-injection cut-off port 19 of the control sleeve 3.

With this pre-injection, fuel corresponding to the pilot stroke PS (cf. FIG. 4) is injected, and, with the lift condition (4) as the apex, the plunger 2 first descends, as in lift condition (5), due to the cam surface between the pre cam nose 21 and the main cam nose 20 of the cam 4, and, when it passes through the pilot stroke PS, pilot injection is performed with a similar stroke as for the pre-injection described above.

When the plunger 2 rises farther, the communication with the small-diameter part 19B of the pilot-injection cut-off port 19 is interrupted, and, therefore, the fuel compression chamber 8 again enters a closed-off condition whereupon main injection commences. Lift condition (6) is a condition in which this main injection has already been entered into; the inclined control channel 14 engages with the main-injection cut-off port 18 due to the further lift of the plunger 2, causing main injection to terminate.

More particularly, when the plunger 2 rises farther, and the inclined control channel 14 communicating with the fuel intake-discharge hole 12 now communicates with the main-injection cut-off port 18 of the control sleeve 3, the main-injection cut-off port 18 and the fuel compression chamber 8 communicate via the main-injection cut-off port 18, the inclined control channel 14, the vertical communicating channel 15, the fuel intake-discharge hole 12, and the center communicating hole 13, wherefore the fuel in the fuel compression chamber 8 escapes to the fuel collection chamber 6, the pressure on the fuel in the fuel compression chamber 8 declines, and injection (fuel line pressurization) terminates.

Lift condition (7) is a condition wherein main injection has terminated, with fuel corresponding to the main stroke MS being injected by main injection.

Then, when the plunger 2 descends, fuel is pulled from the fuel collection chamber 6 into the fuel compression chamber 8 via the fuel intake-discharge hole 12 due to the negative pressure on the fuel.

The pilot stroke PS, moreover, can be varied by moving the control sleeve 3 up and down by the timing control rod 11, and it is also possible to omit the pilot injection only, by designing a partial cam profile 4*a,* as desired, in the cam 4, as represented by the imaginary line in FIG. 1, for example.

The main stroke MS, furthermore, can be varied by regulating the timing of the engagement between the inclined control channel 14 and the main-injection cut-off port 18, by turning the injection-volume regulating rod 10 of the plunger 2.

The stroke Sl from the cam-lift reference point to the pilot stroke PS can be varied, varying the pre-stroke by moving the control sleeve 3 up or down by the timing control rod 11. Stroke S2, moreover, which corresponds to the interval between the pilot stroke PS and the main stroke MS, similarly, can be varied, varying the pre-stroke by moving the sleeve 3 up or down by the timing control rod 11.

Furthermore, by forming the pilot spill slit 16 to the prescribed length, it is possible to perform pilot injection at pre-stroke values either in the low-load or high-load region. By limiting the position in the circumferential direction of the pilot spill slit 16, making use of the fact that the position of slit cut-off in the circumferential direction of the pilot spill slit 16 is changed by the turning of the plunger 2, it is possible to limit the load region in which pilot injection occurs.

In other words, it is possible either to perform no pilot injection at times of low load or, conversely, to perform no pilot injection at times of high load.

As explained in the forgoing, according to the present invention, both a main cam nose and a pre cam nose are formed in the cam in a fuel injection pump comprising a mechanism that makes prestroke variable; wherefore two-stage injection is possible, even in an ordinary jerk type of fuel injection pump, so that it is possible to obtain stabilized fuel injection and to prevent ignition lag.

What is claimed is:

1. A fuel injection pump comprising:

a plunger barrel having a fuel pressure chamber;

a plunger that reciprocates up and down inside said plunger barrel, pulling fuel into said fuel pressure chamber from a fuel collection chamber via a fuel intake-discharge port, and sending this fuel along under pressure;

a freely sliding control sleeve that fits over said plunger; and a cam that drives said plunger;

fashioned so that the pre-stroke is regulated by changing the relative positions of said control sleeve and said plunger in the axial dimension;

said cam comprising: a main cam nose for the main injection; and a pre-cam nose for pre-injection positioned roughly 180 degrees before said main cam nose.

2. The fuel injection pump according to claim 1, wherein said main injection is performed in the vicinity of top dead center in the compression stroke of the engine, and said pre-injection is such that a small quantity of fuel is preliminarily injected in the vicinity of top dead center in the exhaust stroke of the engine.

3. The fuel injection pump according to claim 1, wherein said cam is provided in a camshaft that is driven by the engine so as to turn, and said plunger is made to reciprocate by said cam.

4. The fuel injection pump according to claim 1, wherein both the volume injected by said pre-injection and the timing thereof relative to said main injection are made variable by the regulation of said pre-stroke.

5. The fuel injection pump according to claim 1, wherein said plunger comprises: a center communicating hole formed in the direction of the center axis so that said fuel intake-discharge hole and said fuel compression chamber communicate; an inclined control channel formed in the outer surface thereof; and a vertical communicating channel that communicates with said inclined control channel.

6. The fuel injection pump according to claim 1, wherein a main-injection cut-off port and a pilot-injection cut-off port are formed in said control sleeve, and an inclined control channel and a pilot spill slit corresponding thereto are formed in said plunger, whereby, together with said main injection, a pilot injection is performed immediately prior thereto.

7. The fuel injection pump according to claim 6, wherein said pre-injection injects fuel corresponding to the pilot stroke in said pilot injection.

8. The fuel injection pump according to claim 6, wherein the stroke from the cam-lift reference point of said cam to the pilot stroke of said pilot injection is made variable, varying said pre-stroke by moving said control sleeve up or down.

9. The fuel injection pump according to claim 6, wherein the stroke corresponding to the interval between the pilot stroke of said pilot injection and the main stroke of said main injection is made variable, varying said pre-stroke by moving said control sleeve up or down.

* * * * *